US005992965A

United States Patent [19]

Katayanagi et al.

[11] Patent Number: 5,992,965

[45] **Date of Patent: *Nov. 30, 1999**

[54] SUCTION RECOVERY DEVICE WITH A CAP HAVING A SHAPE CORRESPONDING TO A CONTOURED DISCHARGE PORT FACE

[75] Inventors: Jun Katayanagi, Masashino; Masasumi Nagashima, Tokyo; Kazuya Iwata, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/478,361

[22] Filed: Jun. 7, 1995

Related U.S. Application Data

[63] Continuation of application No. 08/408,194, Mar. 21, 1995, abandoned, which is a continuation of application No. 07/910,456, Jul. 8, 1992, abandoned, which is a division of application No. 07/653,703, Feb. 11, 1991, Pat. No. 5,164,748.

[30] Foreign Application Priority Data

Feb. 13, 1990 [JP] Japan ..... 2-29409
Apr. 18, 1990 [JP] Japan ..... 2-102648

[51] Int. Cl.[6] ..... B41J 2/165

[52] U.S. Cl. ..... 347/29; 347/32

[58] Field of Search ..... 347/29, 30, 31, 347/32, 22

[56] References Cited

U.S. PATENT DOCUMENTS

| | | | |
|---|---|---|---|
| 4,306,245 | 12/1981 | Kasugayama | 347/28 X |
| 4,313,124 | 1/1982 | Hara . | |
| 4,345,262 | 8/1982 | Shirato et al. . | |
| 4,394,669 | 7/1983 | Ozawa | 347/30 |
| 4,459,600 | 7/1984 | Sato et al. . | |
| 4,463,359 | 7/1984 | Ayata et al. . | |
| 4,506,277 | 3/1985 | Terasawa . | |
| 4,558,333 | 12/1985 | Sugitani et al. . | |
| 4,586,058 | 4/1986 | Yamazaki . | |
| 4,600,931 | 7/1986 | Terasawa . | |
| 4,723,129 | 2/1988 | Endo et al. . | |
| 4,739,340 | 4/1988 | Terasawa | 347/30 |
| 4,740,796 | 4/1988 | Endo et al. . | |
| 4,819,012 | 4/1989 | Kiyohara et al. . | |
| 5,055,856 | 10/1991 | Tomii | 347/30 |

FOREIGN PATENT DOCUMENTS

| | | | |
|---|---|---|---|
| 0358487 | 3/1990 | European Pat. Off. . | |
| 59-055757 | 3/1984 | Japan . | |
| 59-123670 | 7/1984 | Japan . | |
| 59-138461 | 8/1984 | Japan . | |
| 59-159017 | 9/1984 | Japan . | |
| 60-141564 | 7/1985 | Japan . | |
| 162656 | 8/1985 | Japan | B41J 3/04 |
| 2202800 | 10/1988 | United Kingdom . | |

*Primary Examiner*—Joseph Hartary
*Attorney, Agent, or Firm*—Fitzpatrick, Cella, Harper & Scinto

[57] ABSTRACT

An ink jet recording apparatus having an ink jet recording head and a cap. The apparatus includes a recording head, the recording head having a discharge port face with a discharge port arranged thereon, and a recovery device, the recovery device including the cap for covering the discharge port face, the cap having an interior and including a body portion and an edge portion opposing the discharge port face and having a leading end, the edge portion including an elastic member for covering a periphery of the discharge port, wherein during a capping operation a plane defined by the leading end of the edge portion is not parallel to the discharge port face and the edge portion is not displaced in a direction different from a capping direction between the cap and the ink jet recording head. A part of the leading end of the edge portion in contact with the discharge port face defines a contact portion between the leading end of the edge portion and the discharge port face, and the contact portion increases during the capping operation as the leading end approaches the discharge port face and gradually comes into contact with the discharge port face, the discharge port face being capped with the entire leading end of the edge portion in contact therewith when the capping operation is terminated.

9 Claims, 13 Drawing Sheets

SUCTION RECOVERY DEVICE WITH A CAP HAVING A SHAPE CORRESPONDING TO A CONTOURED DISCHARGE PORT FACE

This application is a continuation of application Ser. No. 08/408,194 filed Mar. 21, 1995 now abandoned, which is a continuation of application Ser. No. 07/910,456 filed Jul. 8, 1992 now abandoned which is a division of application Ser. No. 07/653,703 filed Feb. 11, 1991 now U.S. Pat. No. 5,164,748.

DESCRIPTION OF THE INVENTION

1. Field of the Invention

The present invention relates to a suction recovery device applicable to an ink jet recording apparatus or the like, and the ink jet recording apparatus with said device.

2. Related Background Art

Conventionally, there is typically disclosed in U.S. Pat. No. 4,600,931 a configuration in which a recording head is capped with a capping member. This patent disclosed that a cap face is formed so as to come into close contact with a discharge port formation face of head in capping the recording head with the cap.

And the discharge port formation face for the conventional recording head was formed on a surface parallel to a record face of recording medium. The cap face of capping member was formed parallel to the discharge port formation face. This capping member was constructed of at least an elastic body abutting on or directly supported by a support member for suction recovery, with an ink exhaust path of the elastic capping member communicating with an ink guide path of the support member corresponding thereto.

Such a capping member was required to effectively exhaust the ink contained within it out of the cap with suction means, along with an air tightness in capping the recording head, but there is a technical problem as described below.

Recently, from a manufactural and technical problem, a new recording head has appeared, in which the discharge port formation face is inclined against the record face as above indicated by a predetermined angle and is provided with a slight step near discharge ports. Even if such a cap with a capping face corresponding to such discharge port formation face was fabricated, it was practically difficult to shut the cap completely due to a relationship with the positional precision between the head and the cap, resulting in a problem that it might not be tightly enclosed due to a clearance between the head and the cap caused by a misregistration therebetween.

Furthermore, there occurred a phenomenon that since the capping member is closed with a deformation owing to a biasing force in capping, the volume within the cap will decrease to cause an increased pressure within the cap. A communicating port was provided to avoid the meniscus regression in the discharge ports caused by this phenominum, which led to a problem that a mechanism for controlling the opening or closing of the communicating port was needed.

It was a possibility that since the recording head and the capping member are repeatedly attached or detached each other, in each time the capping member is repeatedly deformed elastically, with a result that the elastic characteristic is especially lowered at a direct contact portion, an escape of ink might occur a little at that direct contact area as above indicated, when used for a long time. Further, it has been found that the above mentioned tendency is especially strong with such a configuration that the capping member is equalized so as to come into stable and direct contact with the recording head.

SUMMARY OF THE INVENTION

According to one aspect of the present invention, an ink jet recording apparatus having an ink jet recording head and a cap includes, on the recording head, a discharge port face with a discharge port arranged thereon, and a recovery device, the recovery device including the cap for covering the discharge port face. The cap has an interior and includes a body portion and an edge portion opposing the discharge port face and having a leading end, the edge portion including an elastic member for covering a periphery of the discharge port, wherein during a capping operation a plane defined by the leading end of the edge portion is not parallel to the discharge port face and the edge portion is not displaced in a direction different from a capping direction between the cap and the ink jet recording head. Also according to this aspect, a part of the leading end of the edge portion in contact with the discharge port face defines a contact portion between the leading end of the edge portion and the discharge port face, and the contact portion increases during the capping operation as the leading end approaches the discharge port face and gradually comes into contact with the discharge port face, the discharge port face being capped with the entire leading end of the edge portion in contact therewith when the capping operation is terminated.

DETAILED DESCRIPTION OF PREFERRED EMBODIMENTS

EXAMPLE 1

An example of the present invention will be described in detail with reference to the drawings.

Figure 1:
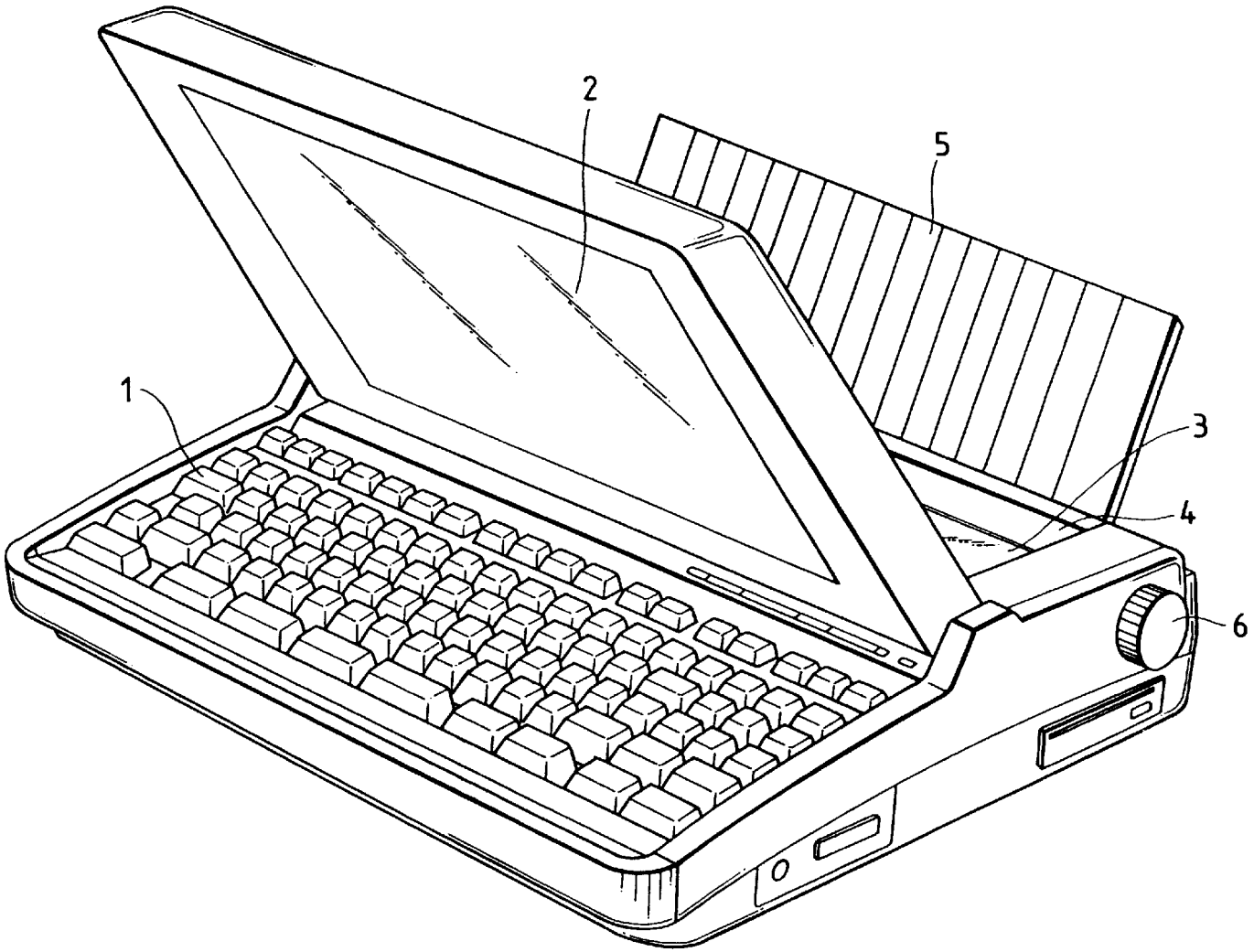
FIG. 1 is a PERSPECTIVE VIEW SHOWING A CONFIGURATION OF A WORD PROCESSOR AS ONE EXAMPLE OF DEVICE TO WHICH THE PRESENT INVENTION IS APPLIED.

FIG. 1 shows an external perspective view of a configuration for a document making apparatus (thereafter referred to as a word processor) to which the present invention is applicable.

Here, 1 is a keyboard portion which is an input device. 2 is a display portion for displaying an input document or the like, which is held rotatably and lapped over the keyboard portion 1 when not used.

3 is a protection cover openable/closable provided on a visual opening to assure an operating state of said recording head, which is transparent or translucent. 4 is a spur cover for carrying a spur. They will be described later in connection with FIGS. 6 to 8.

5 is a paper supporter against which a record paper is supported for feeding or exhausting, and 6 is a knob for feeding and exhausting the record paper manually.

Figure 2:
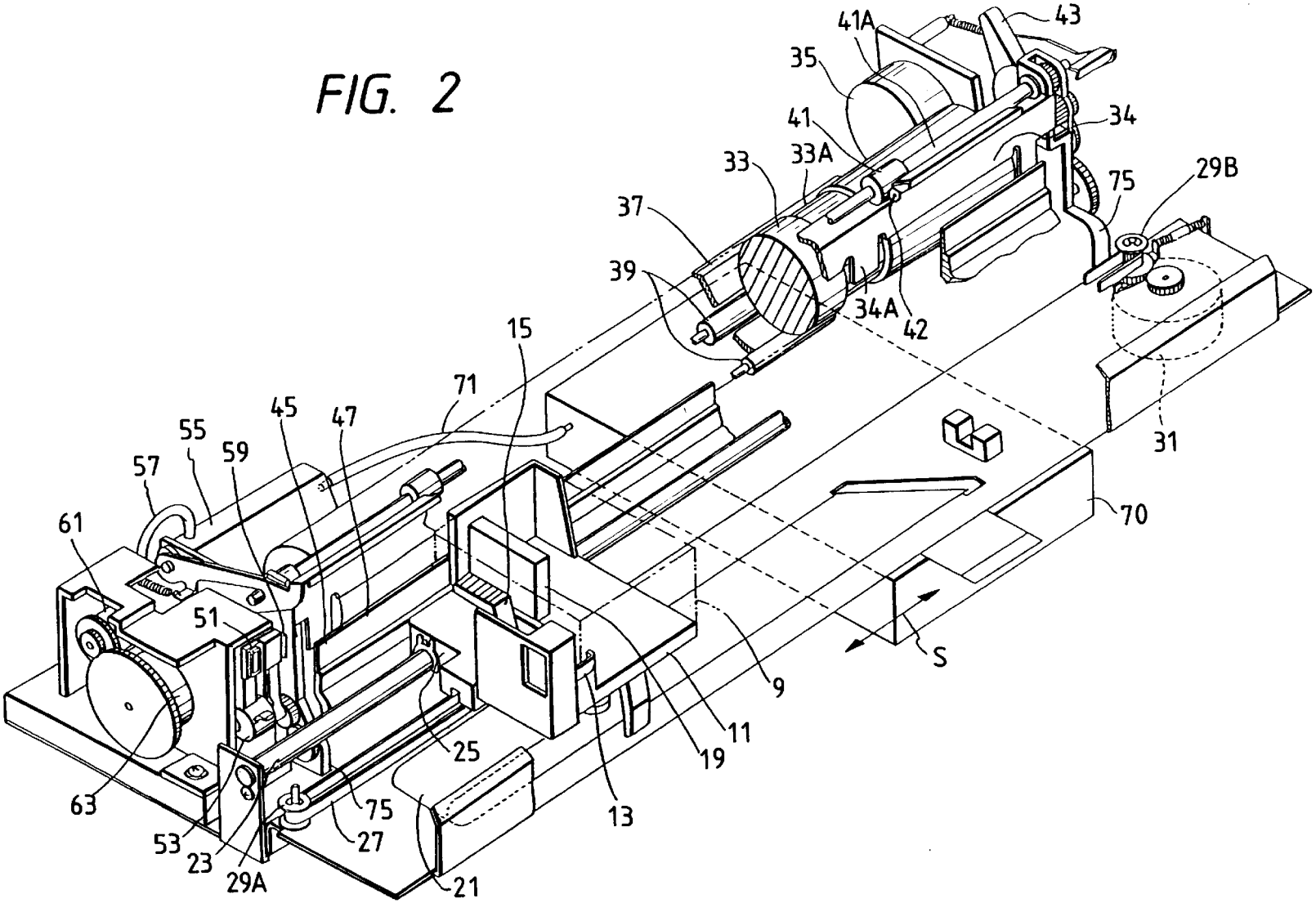
FIG. 2 is a perspective view showing one example of an ink jet recording apparatus as a printer portion thereof.

FIG. 2 shows a configuration example of a printer portion in the form of an ink jet recording apparatus according to this example.

Figure 3:
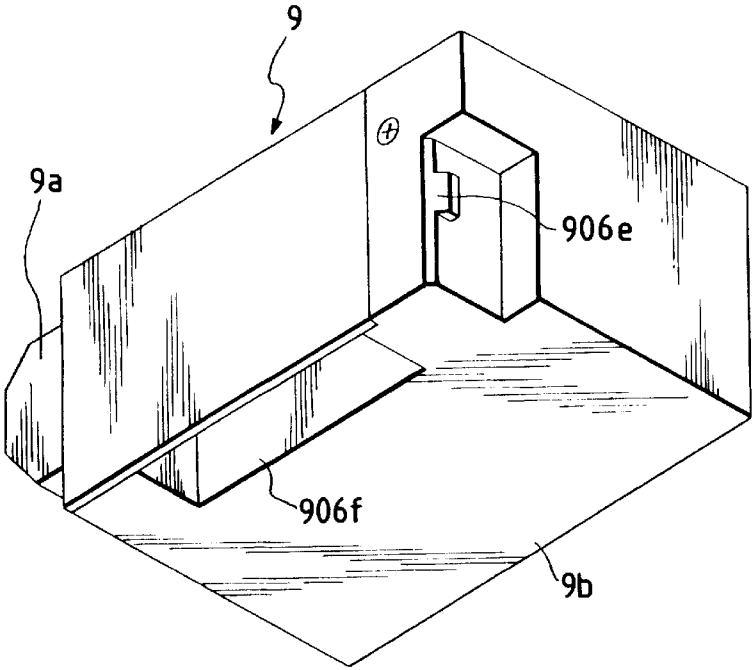
FIG. 3 is an external perspective view of a head cartridge as shown in FIG. 2.
Figure 10:
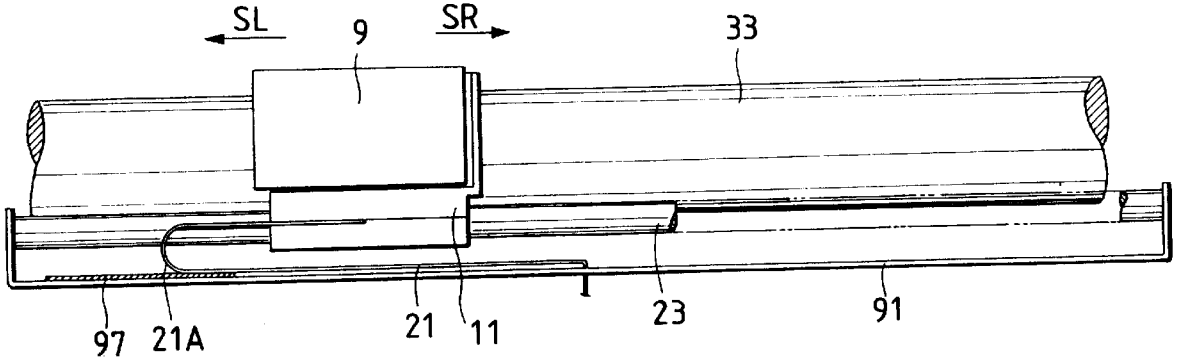
Figure 11:
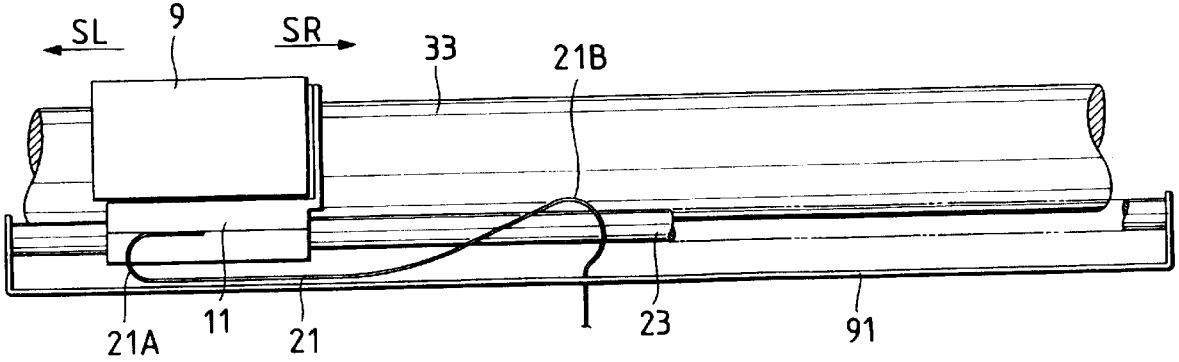
FIG. 11 is a front view of a printer portion for explanation of a FPC insert according to a conventional configuration.

Here 9 is a head cartridge having an ink jet recording head, as will be described in detail with reference to FIG. 3 and 4, and 11 is a carriage for mounting the head cartridge 9 and scanning in the S direction in the figure. 13 is a hook for attaching the head cartridge 9 onto the carriage 11, and 15 is a lever for operating the hook 13. 19 is a support plate for supporting an electrical connection to the head cartridge 9. 21 is FPC for connecting between the electrical connection and a control section of main body. A configuration associated with the FPC will be described with reference to FIG. 9 to 11.

23 is a guide shaft for guiding the carriage 11 in the S direction, which is inserted through bearings 25 of the carriage 11. 27 is a timing belt for transmitting a power to move the carriage 11 fixed thereto in the S direction, passing under tension about pulleys 29A, 29B arranged on both sides of the apparatus. One pulley 29B is supplied with a driving force transmitted via a transmission, e.g. a gear, from a carriage motor 31.

33 is a conveying roller for conveying a recording medium, e.g. a paper (thereafter referred to as a recording paper) on recording, as well as regulating a record face of the recording medium, and it is driven by a conveying motor 35. 37 is a paper pan for guiding the recording medium from the paper supporter 5 to a recording position, and 39 is a feed roller, disposed on a way of feed path for the recording medium, for biasing the recording medium toward the conveying roller 33 to convey it. 34 is a platen for regulating the record face of the recording medium, which is opposed to discharge ports of the head cartridge 9. 41 is a paper exhausting roller for exhausting the recording medium to a paper exhausting port, not shown, which is disposed downstream from the recording position in the direction of conveying the recording medium. 42 is a spur provided correspondingly to the paper exhausting roller 41, for pressing the roller 41 via the recording medium, and developing a force for conveying the recording medium with the paper exhausting roller 41. 43 is a release lever for releasing the energizing state for each of feed roller 39, presser bar 45, and spur 42, when setting a recording medium.

A platen 34 has both ends rotatably supported on an axis of the paper exhausting roller 41, energized from a stop position of left and right plates 75, 75 toward a front portion 45 of the paper pan 37, with a portion 33A of the platen roller 33 rendered smaller than the most external periphery and 34A provided on a plurality of locations in the portion 33A abutting on the inside of the front portion 45 of the paper pan, when there is no recording paper.

51 is a cap made of an elastic material, e.g. rubber, which is placed opposite to an ink discharge port formation face of the recording head in a home position, and supported therein to be able to attach to or detach from the recording head. The cap 51 is used for protecting the recording head when it is not used, or in a discharge recovery processing for the recording head. The discharge recovery process is such a processing that the cap 51 is placed opposed to the discharge port formation face, and the ink is discharged from the whole discharge ports by driving energy generation elements provided inwardly of the ink discharge ports and used for the ink discharge, to remove discharge faulty factors, such as bubbles, dusts, or thickened ink not suitable for recording (predischarge), or otherwise, to remove discharge faulty factors by forcedly discharging the ink from the discharge ports on the discharge port formation face covered with the cap 51.

53 is a pump used to suck the ink received within the cap 51 in the suction recovery process for the forced discharge or predischarge, or to exert a suction force for the forced discharge of ink. 55 is a first waste ink tank for reserving waste ink sucked by the pump 53, and 57 is a tube communicating between the pump 53 and the waste ink tank 55. 70 is a second waste ink tank, which is connected to the first waste ink tank 55 via a tube 71.

59 is a blade for wiping the discharge port formation face of the recording head, which is movably held between a position where it projects toward the recording head for wiping during the movement of head and a retracted position where it does not engage the discharge port formation face. 61 is a motor, and 63 is a cam mechanism for driving the pump 53 and moving the cap 51 and the blade 59, with the power transmitted from the motor 61.

Next, the above mentioned head cartridge 9 will be described in detail.

FIG. 3 shows a perspective view of the head cartridge 9 integral with a discharge unit 9*a* that is an ink jet recording head body and an ink tank 9*b*, where 906*e* is a click engaged by a hook 13 on the carriage 11 in attaching the head cartridge 9. As clearly shown, the click 906*e* is disposed within a whole extension f=of the recording head. And near the discharge unit 9*a* in front of the head cartridge 9 is provided an abutting portion for positioning, not shown. 906*f* is a head opening section into which a support plate stood on the carriage 11 for supporting a flexible substrate (electrical connection portion) and rubber pad is inserted.

Figure 4B:
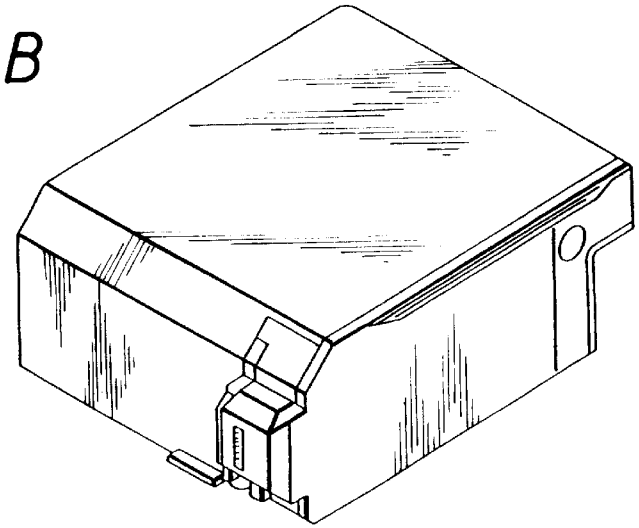
FIGS. 4A and 4B are an exploded perspective view and an external perspective view of the head cartridge as shown in FIG. 3, respectively.
Figure 4C:
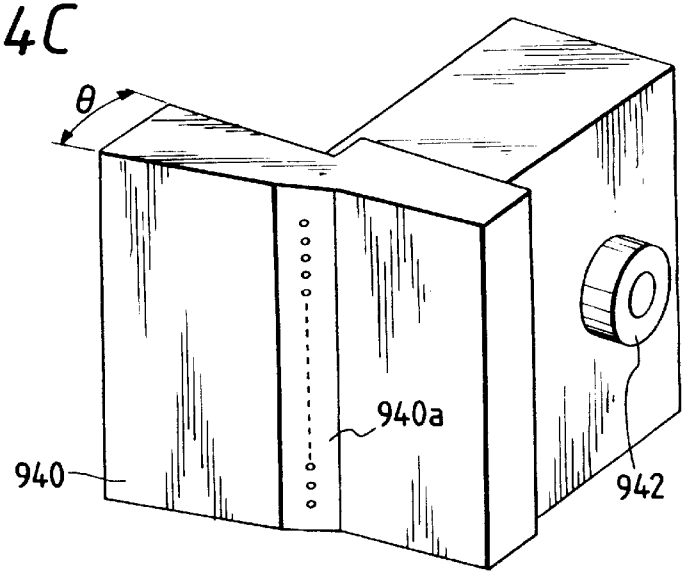
FIG. 4C is a perspective view showing a configuration example of a recording head roof plate as shown in FIG. 4A.
Figure 4A:
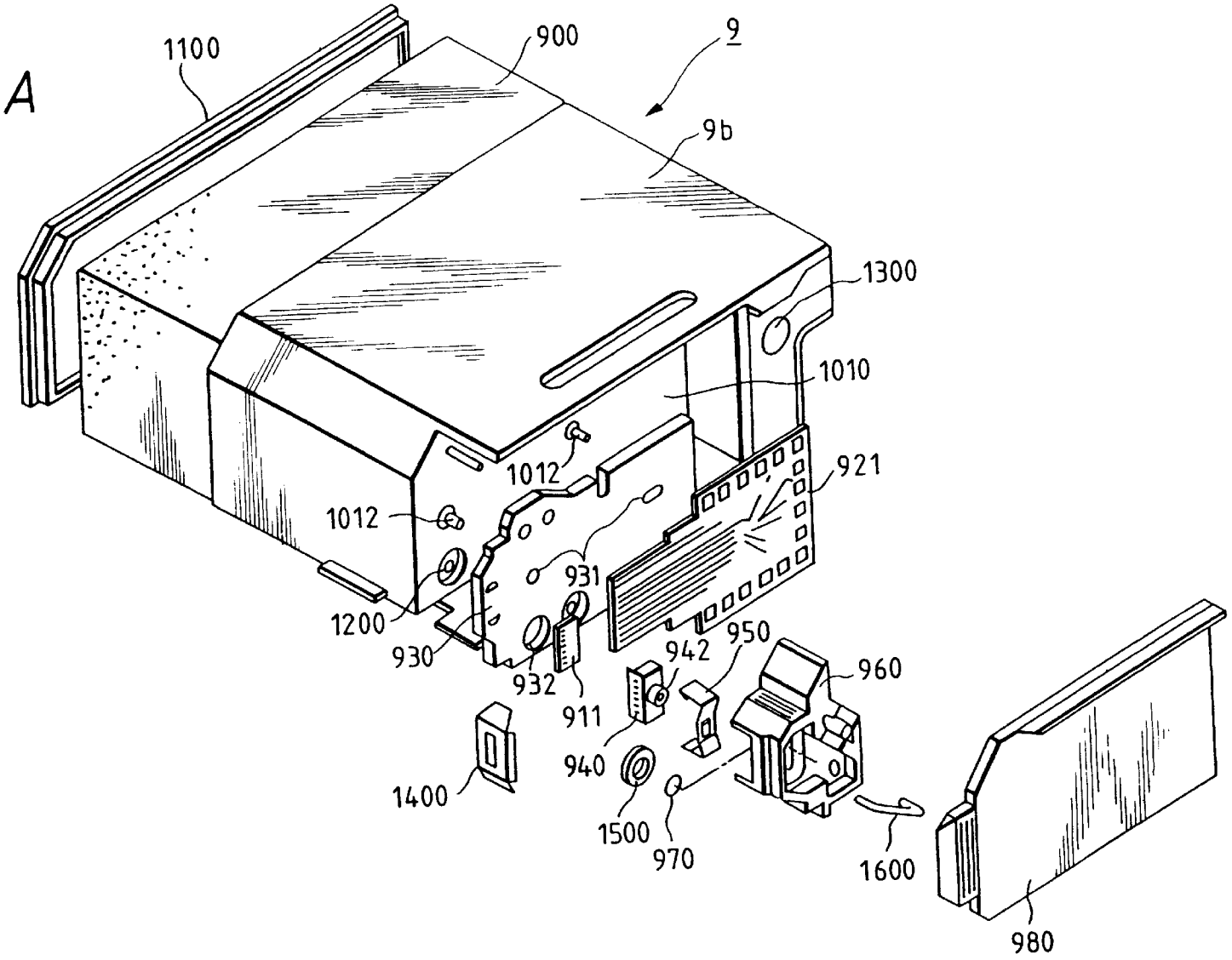

FIGS. 4A and 4B show exploded perspective views of the head cartridge as shown in FIG. 3, which is of a disposable type integrated with an ink storage section which is a supply source of ink, as described above.

In the same figure, 911 is a heater board comprising an electricity heat conversion element (discharge heater) and a wiring made of A1 or the like for supplying the electric power to it, which are formed on a Si substrate with the film technique. 921 is a wiring substrate for the heater board, the corresponding wirings being connected in a wire bonding method, for example.

940 is a roof plate provided with a diaphragm for restricting an ink flow path and a common liquid chamber, made of a resin material integrated with an orifice plate section in this embodiment. As shown in FIG. 4C, the discharge port formation face is inclined by a predetermined angle 6 with respect to a plane parallel to a record face of recording paper, and has a step 940*a* in the vicinity of discharge ports. This was made correspondingly to a predetermined angle between a flow path within an orifice plate portion and a back flow path therefrom, for the machining of the discharge ports which is radiated with the laser beam from the flow path provided on the roof plate.

930 is a carrier made of, for example, metal, and 950 is a presser spring, between which are engagingly carried the heater board 911 and the roof plate 940, to thereby tightly fix them with an energizing force of the presser spring 950. It should be noted that the carrier 930 is pasted with the wiring substrate 921, and has a positioning reference to the carriage 11 for scanning with the head. The carrier 930 also functions as a cooling member for radiating the heat on the heater board 911 generated by driving.

960 is a supply tank, which functions as a subtank for receiving ink from an ink storage 9*b*which is an ink supply source and for conducting ink into the common liquid chamber formed by the joint of the heater board 911 and the roof plate 940. 970 is a filter disposed in a position within the supply tank 960 near an ink supply port into the common liquid chamber, and 980 is a lid member for the supply tank 960.

900 is an absorbing member for impregnating the ink, disposed within the ink tank body 9*b*. 1200 is a supply port for supplying the ink to a discharge unit 9*a* comprising each of portions 911–980 as above indicated, for allowing the impregnation of ink into the absorbing member 900 by injecting the ink through the supply port 1200, in a process before this unit is placed on a portion 1010 of the ink tank body 9*b*.

1100 is a lid member for the cartridge body, and 1300 is an atmosphere communicating port provided on the lid member for communicating the inside of the cartridge to the atmosphere.

After the ink has been filled via the supply port 1200 into the ink tank 9*b*, the discharge unit 9*a* consisting of each of the portions 911–980 is positioned and disposed on the portion 1010. The positioning or fixing at this time can be performed, for example, by fitting a projection 1012 on the ink tank body 9*b* into a corresponding hole 931 on the carrier 930, thereby resulting in the complete head cartridge 9 as shown in FIG. 4B.

And the ink is supplied from the inside of the cartridge through a supply port 1200, a hole 932 on the carrier 930 and an inlet port on the back side of the supply tank 960 as shown in FIG. 4A into the supply tank 960, and after passing through the inside of the supply tank 960, flows out of an outlet port through an appropriate supply tube and an inlet port 942 on the roof plate 940 into the common liquid chamber. At the connections for communicating ink as indicated above, packings such as silicone rubber or butyl rubber are disposed, thereby sealing those connections to secure the ink supply path.

Figure 5:
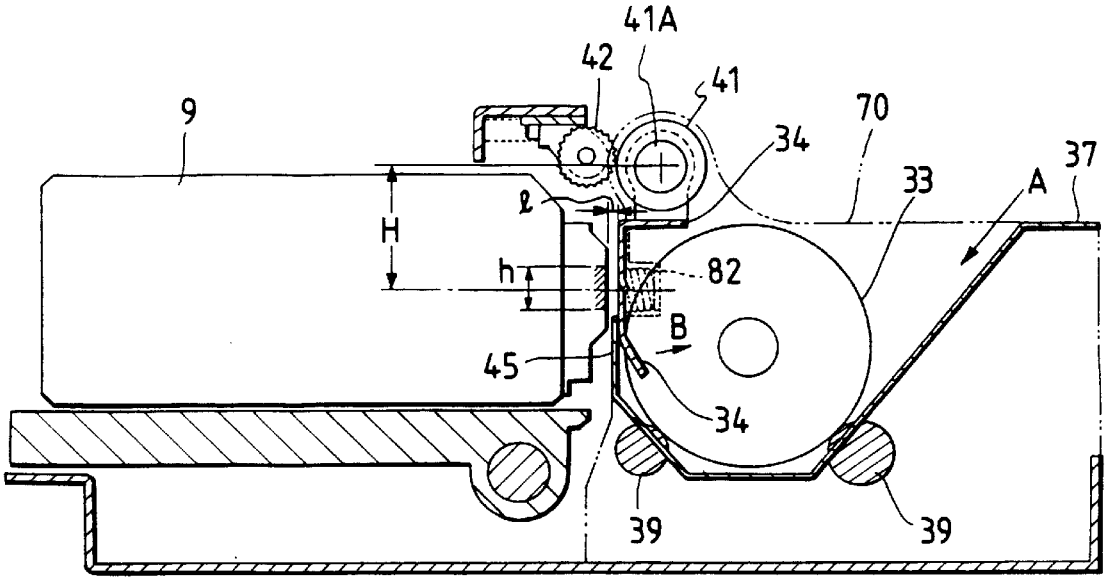
FIG. 5 is a cross-sectional side view of a printer portion for explanation of head gap adjustment means involved in this example.

FIG. 5 is a cross-sectional view of FIG. 2, which shows in more detail the configuration and action of the platen 34 and the paper pan front portion 45.

A distance l (head gap) between discharge ports of the head cartridge 9 and a front face of the platen 34 is adjusted to be optimal for printing.

With such a configuration, a recording paper inserted from the A direction is forced toward a roller 33 by the feed roller 39, and fed with the friction force thereon. A leading end of the recording paper is entered between a rake portion 34A of the platen 34 and an inside of the paper pan front portion 45 by rotating the platen 34 about a shaft 41A as a central rotational axis in the B direction against a force of springs 82 (provided on both sides). Note that the front portion 45 has a properly adjusted and fixed clearance with the discharge port formation face.

Accordingly, a recording paper on the platen 34 can maintain an optimal head gap with the discharge ports of the head cartridge 9 because the platen 34 retracts in the B direction depending on the thickness of paper.

And on an extension line from a front face of the platen 34 is located a contact point between an exhausting paper roller 41 and a spur 42 even when the platen 34 retracts in the B direction depending on the thickness of a recording paper, whereby a leading end of the recording paper can be easily entered between the exhausting paper roller and the spur 42. A difference between the head gaps above and below a recording portion h due to the inclination of the platen 34 is negligible because of a large distance H between a rotational center of the platen and a print center.

Note that the platen 34 is not necessarily on the same axis as for the roller 41. The front portion 45 does not have to be integrally shaped with the paper pan 37, but may be one that is fixed by an adhesive or a screw. It may also be constructed separately and fixed to the other portion of apparatus.

Figure 6:
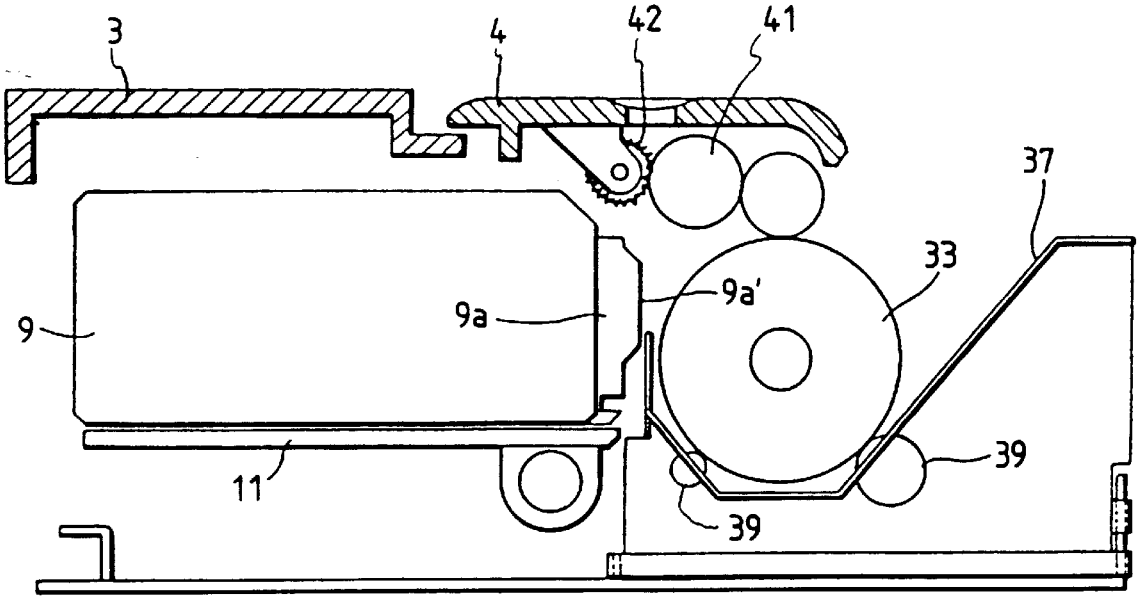
FIG. 6 is a cross-sectional side view of a printer portion for explanation of a spur cover and a visual window involved in this example.

FIG. 6 is a schematic cross-sectional view of a printer portion with a head cartridge 9 mounted and comprising a spur 42, a spur cover 4 and a protect cover 3 containing a visual opening. As seen in this figure, the spur cover 4 is overhung over an upper portion of the head cartridge 9 to form a spur fixing portion.

Accordingly, if the cover 3 is transparent or translucent, the operation of the head cartridge 9 can be visualized with the cover attached, and it is strongly desirable to ensure visually an ink discharge portion 9*a'* of discharge unit 9*a* in a capping position.

Figure 7:
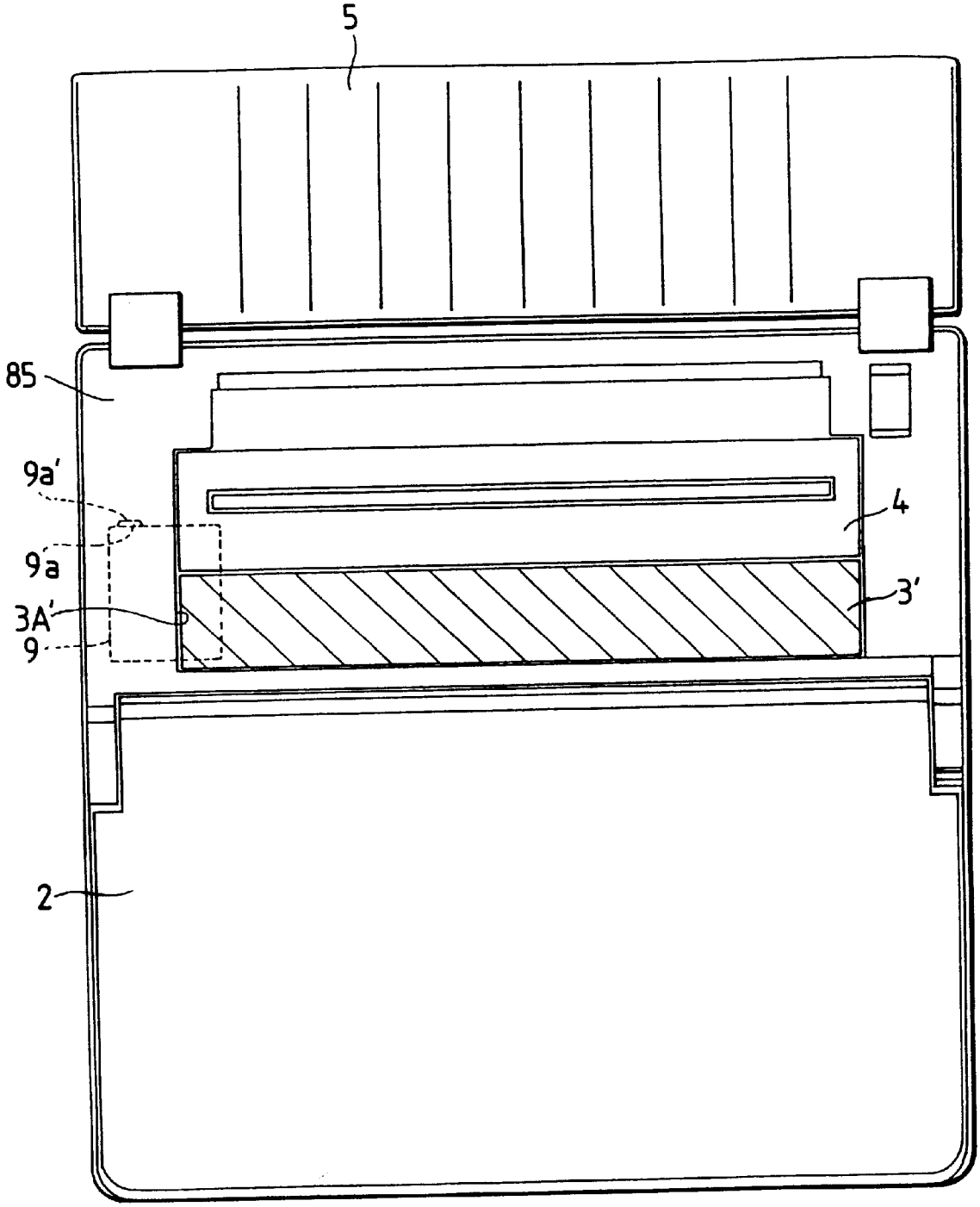
FIG. 7 and FIG. 8 are upper views of a printer portion for explanation of a spur cover and a visual window involved in a comparative example and this example, respectively.

However, in a configuration as shown in FIG. 7, it is impossible to do such a thing. That is, in the same figure, a broken line portion shows a waiting position for the head cartridge 9 in the capping state, in which it is off a paper passing position for a recording medium. As an outer facing member 85 except for an ordinary visual opening 3A' is constructed of an opaque mold material, it is impossible to ensure visually a position of the head cartridge 9 or the discharge unit 9*a* and the ink discharge portion 9*a'* in the capping state. It is also impossible to ensure visually the ink discharge portion 9*a'* and so on by simply widening the visual opening 3A' in the direction of width.

Figure 8:
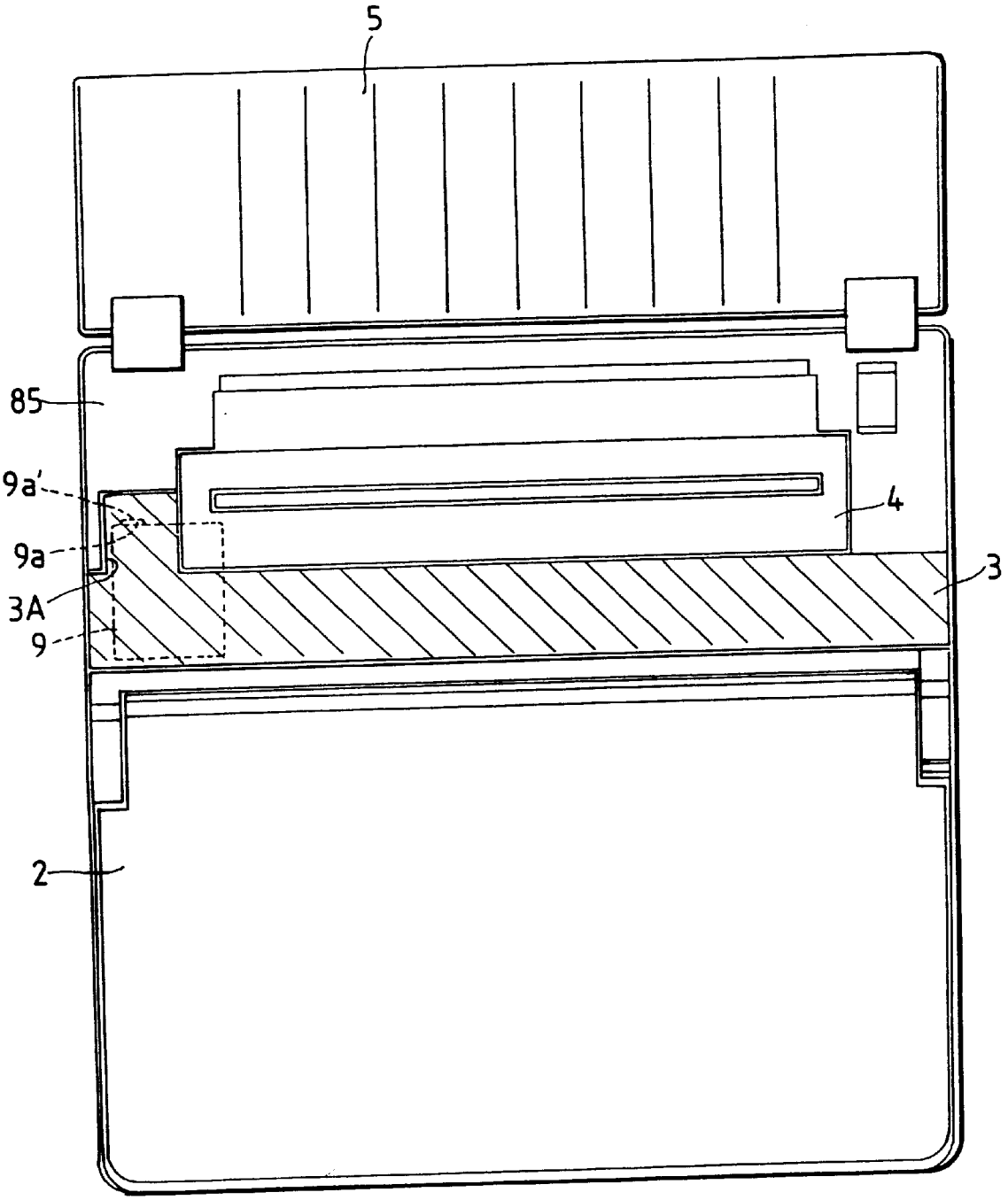

On the contrary, in a configuration of FIG. 8 that was adapted in this example, the ink discharge portion 9*a'* can be also ensured visually, by forming the visual opening 3A in a L-shaped form covering an upper portion of the ink discharge portion 9*a*', as well as widening the visual opening 3A in the direction of width.

In this example, a cover member 3 is provided on the visual opening 3A, to protect the inside of the device such as the head cartridge 9. This cover member 3 may be made of various materials, and by making it transparent or translucent, it is possible to make a visual observation of the capping in the capping state.

However, if the opening 3A can be opened immediately as required, with a configuration where the cover member 3 can be opened or closed or easily attached or detached, it does not necessarily have to be transparent or translucent.

Next, a configuration associated with FPC21 as above shown will be more specifically described in the following.

Figure 9:
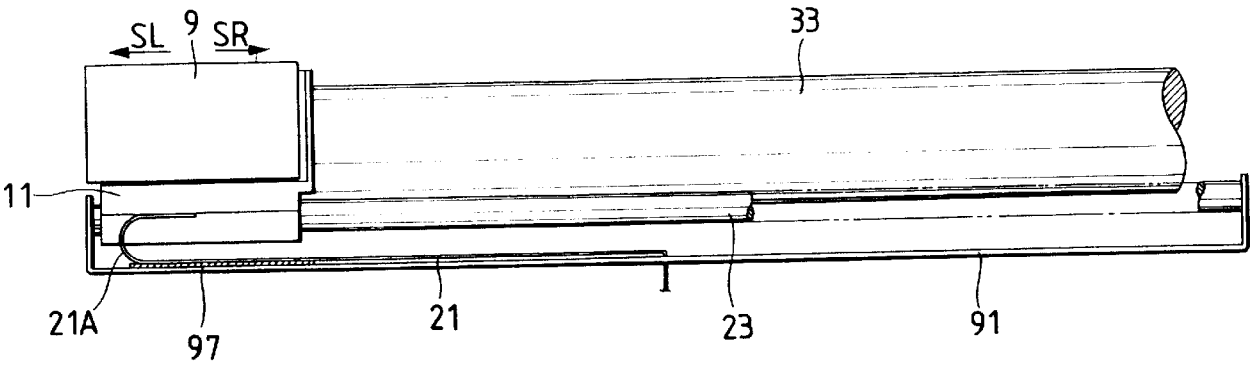
FIG. 9 and FIG. 10 are front views of a printer portion for explanation of FPC insert protecting means involved in this example.

FIG. 9 and FIG. 10 are schematic front views of a recording apparatus involved in this example, and FIG. 11 is a schematic front view of a recording apparatus of the comparative example.

In FIG. 9, left and right frames 75 (not shown in FIG. 9) stood from a frame 91 of the recording apparatus is provided with a roller 33 extending left and right, and in front of the roller 33 is also fixed a guide shaft 23, over which a carriage 11 is provided in a state of slidably moving left and right, and a head cartridge 9 is mounted on the carriage 11, as previously described.

The carriage 11 is provided with FPC21 fixed for connecting electrically a control circuit not shown and the head cartridge 9 via a connector portion provided thereon. FPC21 has the other end fixed to the frame 91.

Furthermore, a friction sheet 97 is provided between FPC21 over the frame 91 and the frame 91 and near a location at which FPC21 forms a minimum radius. The friction sheet 97 has adhesives applied on one side, with which it is joined to the frame 91.

With such a configuration, the carriage 11 moves on a conveying roller 33 in the SR direction as indicated by an arrow SR by driving means such as a motor 31 or the like. Then a recording signal is transmitted from the control portion via FPC21 to the discharge unit 9*a* of the head cartridge 5 mounted on the carriage 11. And the discharge unit 9*a* discharges the ink onto a recording paper in accordance with that signal, to carry out the recording. After one line of record has been completed, the carriage 11 stops, and the roller 33 is driven and rotated by driving means such as motor 35, which causes the recording paper to be sub-scanned.

Thereafter, the carriage 11 moves in the SL direction as indicated by an arrow SL, to accomplish the next recording.

FIG. 10 shows the movement as above indicated, in which as in this example, the friction sheet 97 is provided on the frame 91, a friction force will occur between FPC21 and the friction sheet 97, so that an arc portion 21A of FPC21 moves correctly without sliding with the frame 91, and hence is not rolled into a bottom portion of the carriage 11.

On the contrary, with a configuration without a friction sheet, a sliding will occur between FPC21 on a bottom portion of the carriage 11 and the frame 1, which results in a slack 21B on a portion over FPC21, and if the carriage 11 further moves in the right direction (SR direction) in this state, there occurs a fear that FPC21 may be rolled into the carriage 11.

As described above, according to this example, by making a simple configuration of providing a high friction coefficient member (friction sheet 97) on the frame 91 of recording apparatus, the running of FPC21 can be stabilized, thereby the height of FPC running portion can be reduced, and so a compact and light weight recording apparatus can be provided.

It should be noted that the friction sheet 97 is made of, for example, a sheet material of silicone.

In the above explanation, the connection between the head cartridge 9 and the control circuit was made with FPC, but it is not limited to FPC, and it can be of course accomplished by all electrical connection members such as a flat cable or bundle wire.

Figure 12:
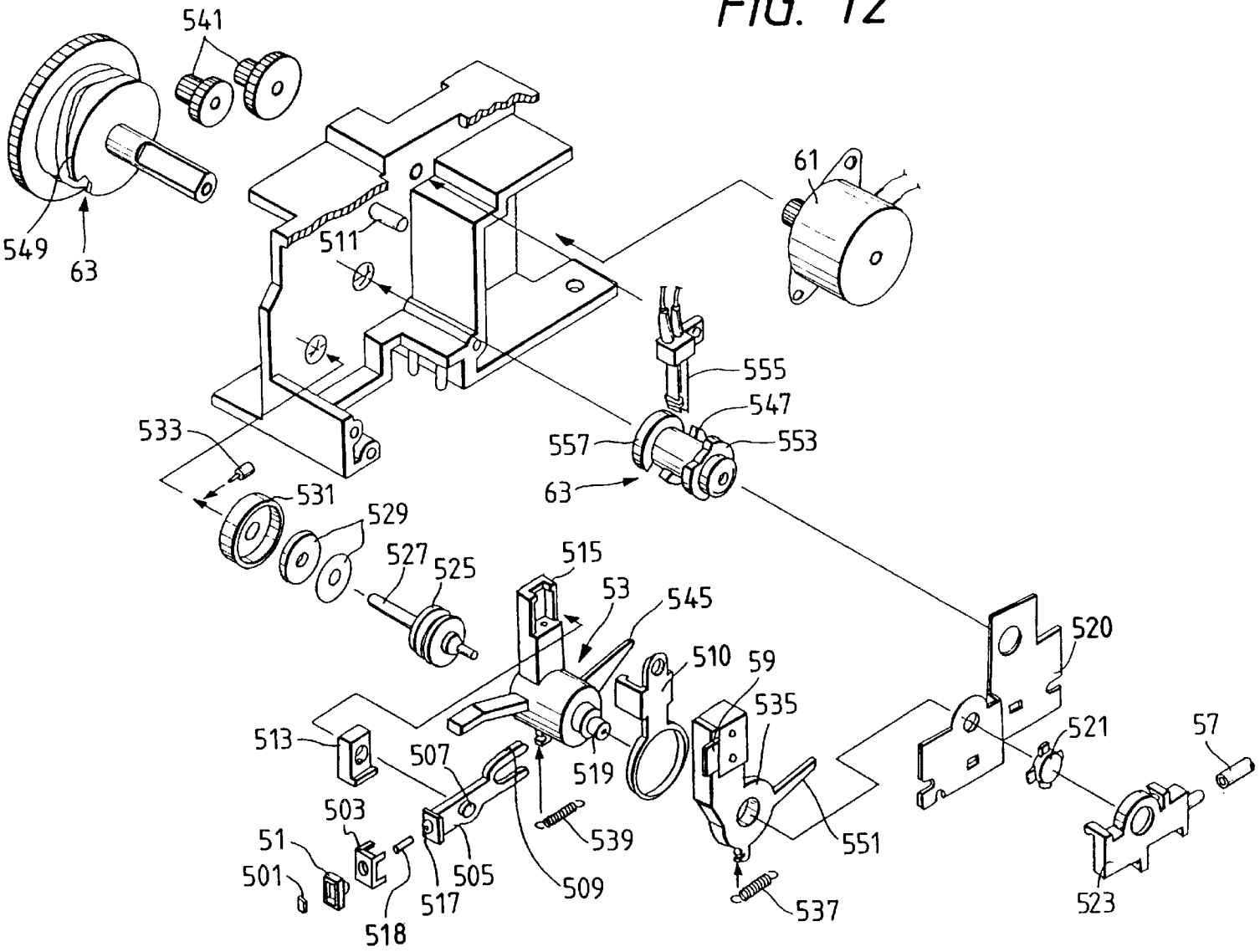
FIG. 12 is an exploded perspective view of a suction recovery device as shown in FIG. 2.

FIG. 12 is an exploded perspective view showing a main portion of the recovery device comprising a cap 51, a pump 53, a blade 59, a motor 61 and a cam mechanism 63 as shown in FIG. 2.

501 is an ink absorbing member disposed in the inside of the cap 51, 503 is a holding member for holding the cap 51, and 505 is a cap lever rotatably mounted around a pin 507, for attaching the cap 51 to or detaching it from a discharge port formation face of the discharge unit 9*a* with a force applied to the pin 507. 511 is a pin for regulating the range of rotation for the cap lever 505, by being engaged with an end portion 509 of the cap lever 505.

513 is a jig having a hole, into which the pin 507 of the cap lever 505 is fitted, which is used to attach the cap lever 505 onto a support 515 on the pump 53. 516 is a stop member for securing the attached state. 517 is a working section for exerting on the cap the force for bringing the cap 51 into direct contact with the discharge port formation face, which is engaged almost centrally in a back side portion of the cap 51. The working section is provided with an inlet port 517C for sucked ink, and ink flow paths are formed inside the cap lever 505, the pin 507, the jib 513, and the carrier 515.

The cap 51 is supported on a cap holder 503, with the working portion with the cap lever 505 being configured to be spherical and to be rotatable in all directions. When abutting on the recording head, it follows the shape thereof. If the pump 53 exerts the suction force, the ink is passed through these flow paths into the pump 53 as indicated by an arrow in the figure.

518 is a tube made of an elastic material such as silicone rubber, which is attached to communicate between a hole portion (ink flow path) provided on the working section 517 of cap lever 505 onto the cap 51 and the ink flow path within the cap 51.

519 is a shaft projecting from a center of end face of the pump 53 and internally formed with an ink flow path, and is rotatably attached on the side wall 520. The rotation force of the pump 53 itself is thereby applied via the support 515 onto the cap lever 505, so that the cap 51 moves outward or inward. 521 is a flow path formation member connected to the pump shaft 519, and 523 is an attachment member for a tube 57. That is, ink flow paths are formed in the inside of the shaft 519, the flow path formation member 521 and the attachment member 523, in which the ink sucked by the pump 53 is introduced through those flow paths via the tube 57 into a waste ink tank 55, as indicated by an arrow in the figure.

525 is a piston for the pump 53, 527 is a piston shaft, 529 is a packing, and 532 is a cap of the pump 53. 533 is a pin attached to the piston shaft 527 and for receiving the transmitted force activating the piston 525.

535 is a blade lever to which the blade 59 is attached, rotatably supported around an axis projecting from the end face of the pump 53, and it projects or retracts the blade 59 toward or from the recording head side, respectively, along with the rotation. 537 is a spring for affording a rotational force to the blade lever 535 in the direction of projecting the blade 59. And 539 is a spring for affording a tendency to rotate the pump 53 itself in the direction in which the cap 51 moves toward the recording head.

541 is a gear train for transmitting the rotation of the motor 61 to the cam mechanism 63, which comprises a cam 547 for engaging and rotating an engaging portion 545 on the pump 53, a cam 549 for engaging a pin 533 on the piston shaft 527 of the pump 53 and activating the pump, a cam 553 for engaging and rotating an engaging portion 551 on the blade lever 535, and a cam 557 for engaging a switch 555 for detecting a home position of the cam mechanism 63. The operations of those cams will be described later.

13A is a perspective view showing details of the cap 51 and the holder 503.

The cap 51 involved in this example is formed of a rubber-like elastic body so as to provide a better sealing property with an orifice plate portion of roof plate 940, and is made contact by pressure with the orifice plate portion of the roof plate with a biasing force ranging from about 60 g to about 80 g. And a leading end of rib portion, or a face of the cap 51 opposed to a discharge port formation face, is formed to be parallel in this example, in correspondence with an inclination angle θ as above described (see FIG. 4C), and having a trapezoidal cross section where a leading edge is narrowed and a base is made thicker to follow a step at the discharge ports.

In correspondence with the angle θ, in order to prevent a lateral sliding when pressed against the roof plate 940, ribs 503B and 503C are provided on the cap holder 503. That is, they are adapted to prevent the deformation of the rubber cap itself with the rib 503C, and also prevent whole of the cap 51 and the cap holder 503 from directing away from an attachment face of the cap lever 505, by means of the rib 503B.

Here, the roof plate 940 of the head is not horizontal with respect to a record face of recording medium, or at right angles to the biasing direction of the cap, as previously described in FIG. C, but makes a fixed angle θ(θ=5° in this example) with respect thereto, and has a minute step (about 0.2 mm in this example). In addition, a stop position of the carriage 11 may yield a predetermined amount of drift (e.g. about +0.5 mm) from the aimed position, when a step motor is used as the carriage motor 31.

In order to follow the shape of an orifice plate portion of the roof plate 940, a leading rib 51D is preferably small with a low hardness, while requiring a certain degree of strength to withstand a negative pressure occurring during suction and to retain a tight closeness thereof. As the orifice plate portion of the roof plate 940 has an angle θ, a force will be exerted on the rib 51D of the cap 51, causing the rib to slide laterally, whereby there is a problem of permanent set which may occur when left for a long term.

FIGS. 13A to 13E show an example according to this embodiment.

Figure 13B:
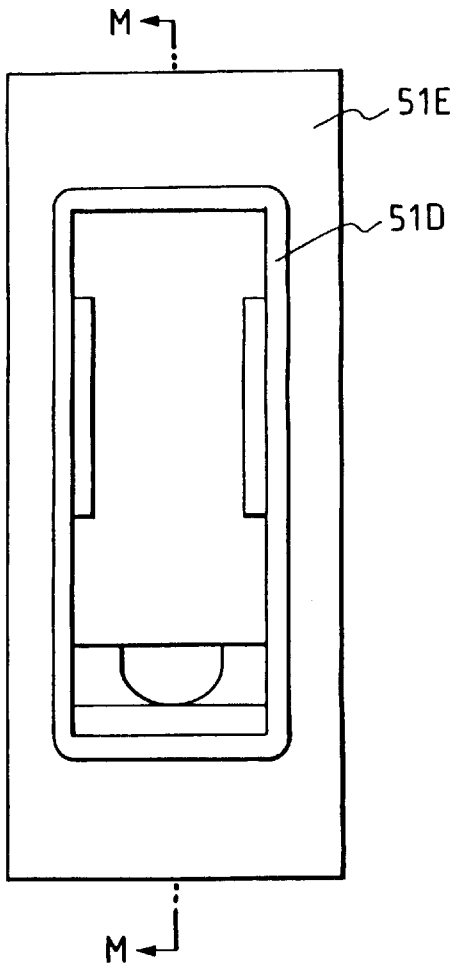
FIG. 13B is a front view of the cap as shown in FIG. 13A.
Figure 13A:
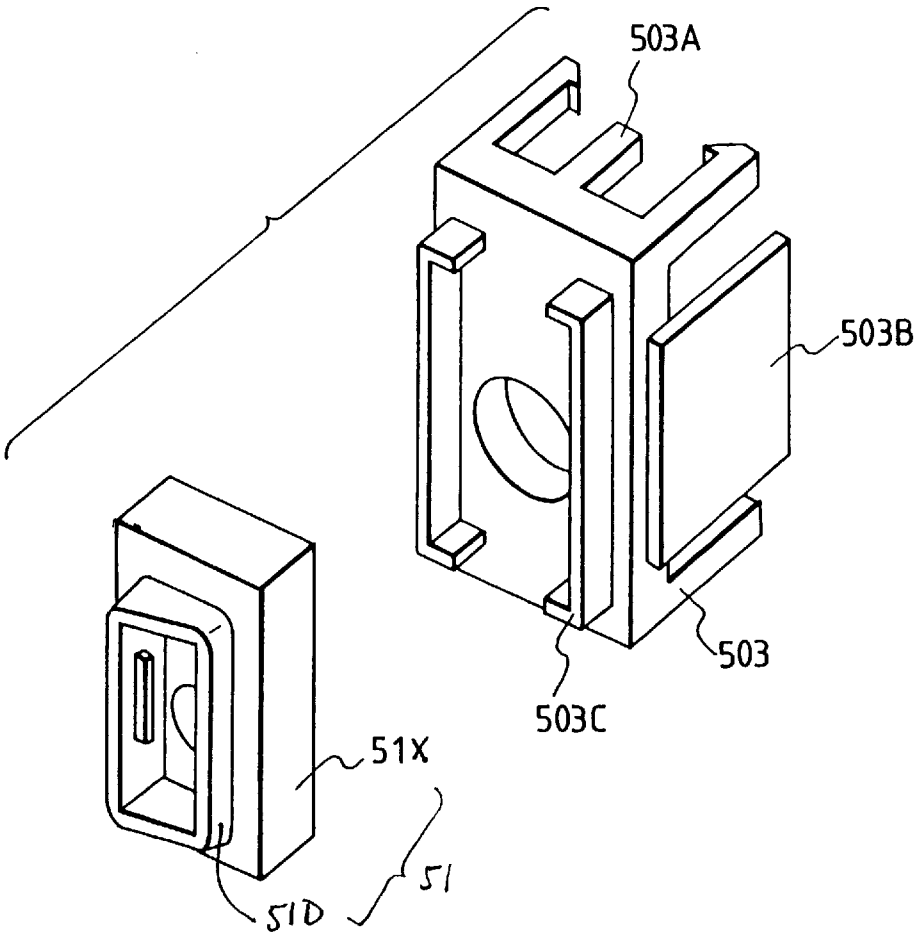
FIG. 13A is a perspective view of a cap for a suction recovery device according to one embodiment of the present invention.

FIG. 13A is a perspective view of a cap portion. The cap 51 has a body portion 51X and a rib or edge portion 51D.

Figure 13C:
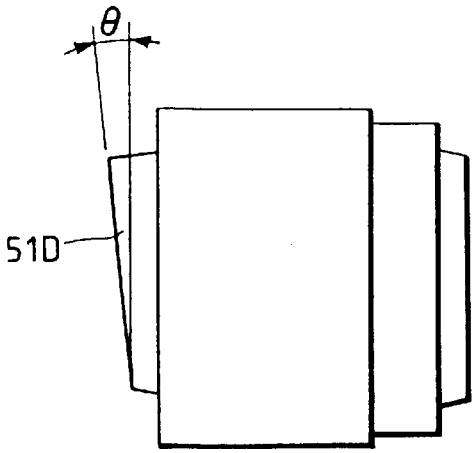
FIG. 13C is a plan view of the cap as shown in FIG. 13A.
Figure 13D:
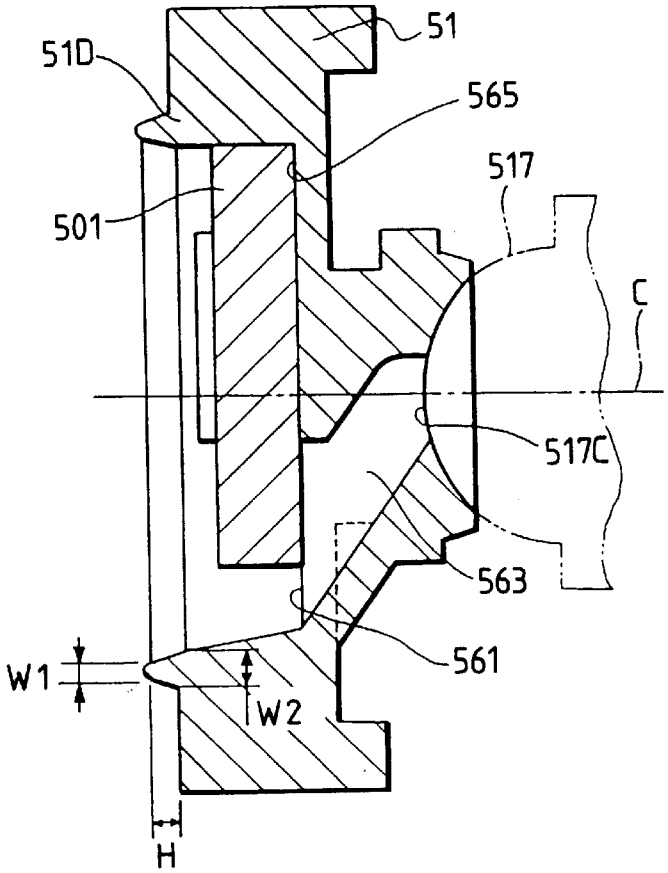
FIG. 13D is a cross-sectional side view taken along a line M—M in FIG. 13B.
Figure 13E:
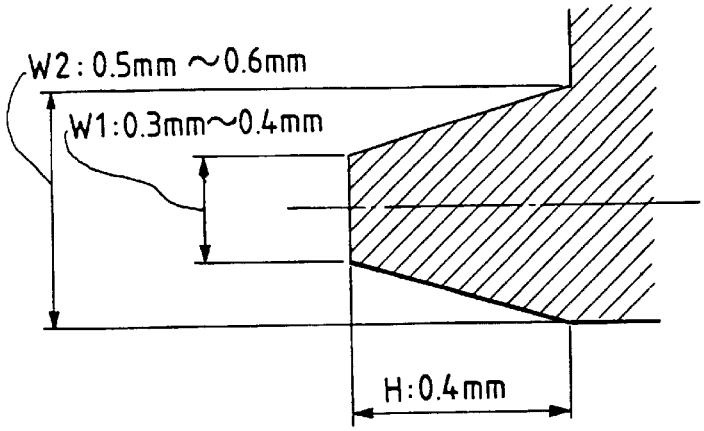
FIG. 13E is a view showing a cross-sectional outline of a leading end portion of a rib for the cap.

FIG. 13B is a front view of a cap 51, FIG. 13C is a plan view of the cap 51, and FIG. 13D is a cross-sectional side view taken along a line M—M of FIG. 13B. FIG. 13E is a view showing a cross section of a rib leading edge portion.

In view of the above mentioned problem, the shape of the rib 51D is selected in this example as follows. That is, the above problem was resolved with W1=about 0.3 mm–0.4 mm, W2=about 0.5 mm–0.6 mm in FIG. 13D, and the hardness of rubber being 600 (in accordance with JIS K6301 A scale).

That is, with a trapezoidal narrow leading edge portion being deformed, even if there are some irregularities, or a minute step 940*a* on the roof plate 940 of the head, the tight closeness can be ensured in capping. Furthermore, due to a strong nerve at the trapezoidal thick base, a lateral sliding can be prevented when the cap 51 is biased against the roof plate 940 with an inclination angle θ to the capping direction. In capping, the inside of cap is placed in a reduced pressure state of 0.4 to 0.7 atm, due to the suction by suction means, but the strong nerve of the trapezoidal cross-sectional rib base can retain the capping air-tight against the force caused by an air pressure difference from the external atmospheric pressure.

At the same time, as a peripheral portion 51E of the rib is sufficiently large with respect to a shape of the rib, the above effect can be more reliably obtained, for example, by making the width for the peripheral portion 51E of the rib greater than 2 to 3 mm, and the thickness greater than 2 to 13 mm.

It should be noted that a rubber in use for the cap is any of a butyl rubber, chlorinated butyl rubber, and silicone rubber.

By the way, the discharge port formation face does not necessarily have to be parallel to a face 51F which an edge section of the rib portion 51D forms.

Figure 13F:
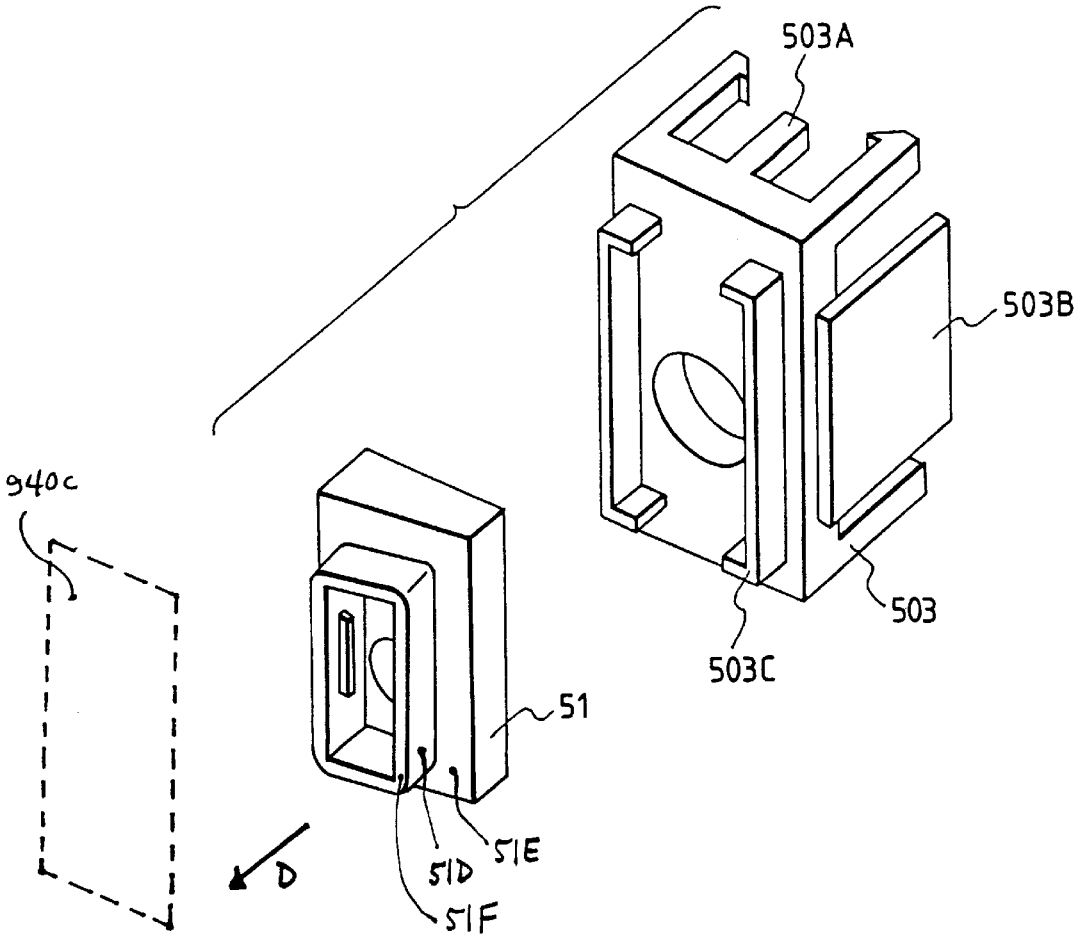
FIGS. 13F to 13H are perspective views of a cap for a suction recovery device according to another embodiment of the present invention.
Figure 13G:
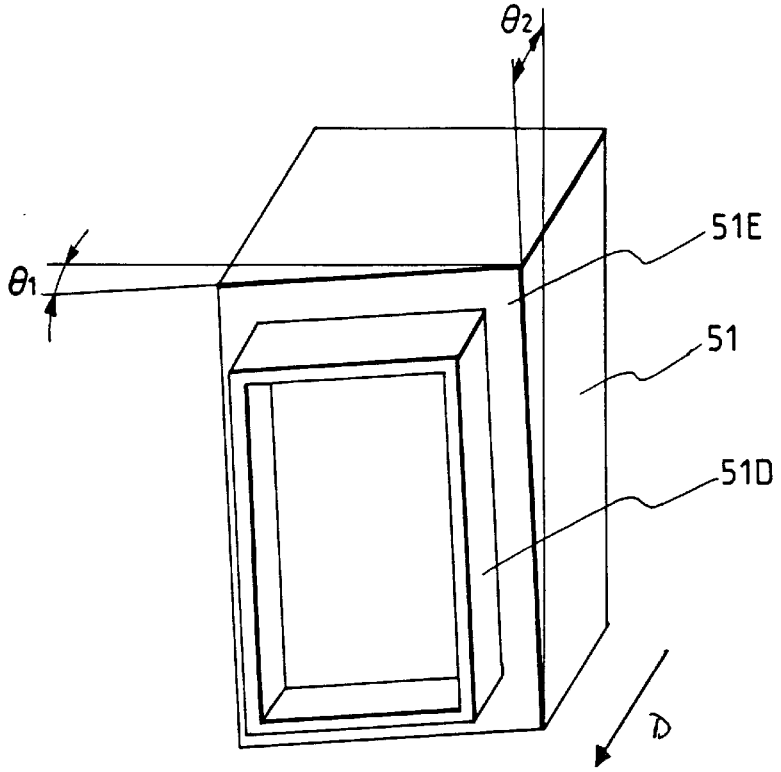
Figure 13H:
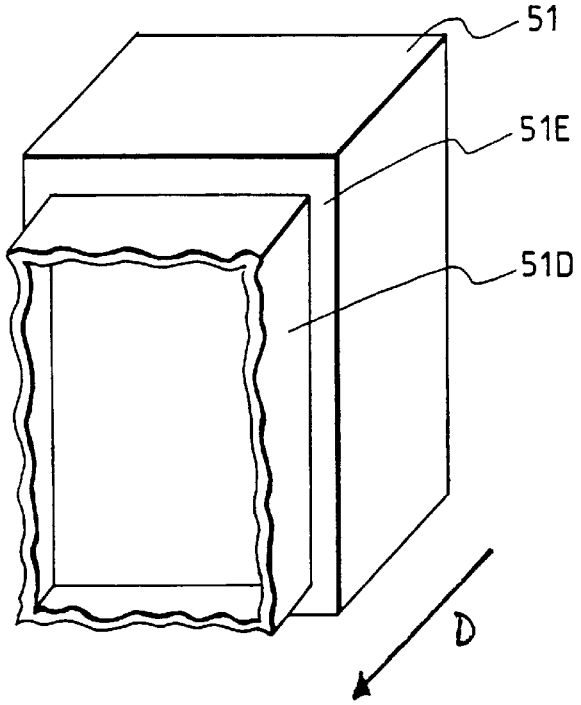

Such another embodiment is shown in FIGS. 13F to 13H.

FIG. 13F is a perspective view of the cap portion with a face 51F of the cap 51 opposed to the discharge port face (shown schematicaly as surface 940*c*) and being inclined thereto. FIG. 13G is a perspective view of the cap with a face of the cap 51 opposed to the discharge port face being inclined laterally by $\theta_1$ and vertically by $\theta_2$, and FIG. 13H is a perspective view of the cap formed with irregularities at the rib edge portion toward the discharge port direction (that is, the capping direction in which the cap is moved toward the discharge port formation face in a capping operation, shown here and in FIGS. 13F and 13G by arrow D).

When the discharge port formation face and the plane of ace 51F are parallel, whole the edge portion simultaneously makes or loses contact with the discharge port formation face in attaching/detaching the cap 51, so that there is a fear that the ink meniscus within the discharge ports may not be retained properly because a large pressure fluctuation may occur instantaneously in a sealed space with the cap 51. That is, by making the discharge port formation face and the plane of face 51F non-parallel, the edge section gradually comes into contact with the discharge port formation face until the whole portion is tightly closed. In opening the cap, the edge section is gradually separated until the complete detachment is accomplished.

In this way, the cap configuration as previously described is not necessarily applied only to a discharge port formation face as shown in FIG. 4C. That is, the above cap configuration is also applicable to the discharge port formation face formed parallel to a record face of recording medium, for example.

A plane which an edge portion forms can take an appropriate direction. Further, it is not necessarily a plane, but may be provided with irregularities on the edge portion.

The recording method used in this invention has an excellent effect on a recording apparatus having a recording head with the ink jet recording method, especially a method in which the state change of ink is caused by the heat energy that is transferred from means for generating the energy for the discharge of ink (e.g. electricity-heat conversion element or laser beam). With such method, a higher density and definition of recording can be accomplished.

The typical construction and principle is preferably based on basic principles as disclosed in U.S. Pat. Nos. 4,723,129 and 4,740,796 specifications. This method is applicable to both a so-called on-demand type and a continuance type, and particularly the on-demand type is more effective because by applying at least one drive signal corresponding to a recording data and causing a rapid rise of temperature exceeding that of the nuclear boiling and, to the electricity-heat conversion element disposed corresponding to a sheet and liquid path where the liquid (ink) is carried, the heat energy is generated in the electricity-heat conversion element, and causes the film boiling on the heat acting surface of the recording head, so that bubbles in the liquid (ink) can be formed corresponding one-to-one to that drive signal. With the growth and contraction of bubbles, the liquid (ink) is discharged through discharge ports to form at least one droplet. If this drive signal is pulse-shaped, the growth or contraction of bubbles can be performed immediately and appropriately, so that the discharge of liquid (ink) is more preferably accomplished with a particularly efficient response characteristic. This pulse-shaped drive signal as described in U.S. Pat. Nos. 4,463,359 and 4,345,262 specifications is appropriate. Under the condition as described in U.S. Pat. No. 4,313,124 specification which is an invention concerning the temperature-rise rate of the above mentioned heat acting surface, the more excellent recording can be performed.

The recording head in accordance with the present invention is constructed with the combination of discharge ports, liquid paths (straight or rectangular liquid paths) and electricity-heat conversion elements, or as described in U.S. Pat. Nos. 4,558,333 and 4,459,600 specifications, an arrangement in which the heat acting portion is disposed in inflection area. In addition, this invention is also effective with the construction based on Patent Laid-Open No. 59-123670 publication which discloses the use of a common slit as discharge portion for a plurality of electricity-heat conversion elements, or Patent Laid-open No. 59-138461 publication which discloses a construction in which an aperture absorbing the pressure wave of heat energy is disposed corresponding to the discharge portion. That is, the recording can be reliably and efficiently performed, according to the present invention, in whatever form the recording head may be made.

Furthermore, this invention is also effective for a full-line type recording head where the recording apparatus has a length corresponding to the maximum width of recording medium to be recorded. Such recording head is constructed in either a combination of a plurality of recording heads to fill that length, or an integrally formed recording head.

In addition, this invention is also effective for a serial-type recording head as above indicated, particularly, a recording head fixed to the body of apparatus, a replaceable chip type recording head which enables the electrical connection to the body of apparatus and the supply of ink from the body of apparatus because it is attached to the body of apparatus, or a cartridge type recording head integrally formed with the ink tank.

It is preferable that recovery means or preliminary auxiliary means for a recording head are added to the construction of a recording apparatus according to this invention, as it can make the effect of this invention more stable. More specifically, it includes capping means for the recording head, cleaning means, pressing or suction means, and preliminary heating means consisting of electricity-heat conversion elements or other heating elements or the combination of both. And the predischarge mode for discharging before the recording is effective to make a stable recording.

As to the type and number of recording heads to be attached, for example, a single type corresponding to a monochromatic ink, or a multiple type corresponding to a plurality of inks differing in color or density may be used. That is, the present invention is also quite effective not only for a recording apparatus having a recording mode based on a main color such as black, but also an apparatus having at least one of the composite color of different colors or the full color with mixed colors, with either an integrally formed recording head or a plurality of recording heads.

Furthermore, though the ink is considered as the liquid in the examples of the present invention as described above, it is also preferable that the ink stiffens below the room temperature and softens or liquefies at the room temperature, or as it is common in the ink jet method to control the temperature to maintain the viscosity of ink within a certain range for stably discharging with the temperature adjustment of ink in the range from 30° C. to 70° C., the ink will liquefy when a use recording signal is issued. In addition, the present invention is also applicable when the ink has the property of liquefying only with the application of the heat energy, such as the ink which liquefies with the application of heat energy in accordance with a record signal to discharge the liquid ink, or the ink which already begins to stiffen at the time when it arrives at a recording medium, with such a manner of preventing the rise of temperature with the heat energy by positively using it as the energy for the change of state from the solid state of ink to the liquid state, or utilizing the ink which stiffens in the shelf state in order to prevent the evaporation of ink. In this case, the ink can be provided to be opposed to electricity-heat conversion elements, in the state where it is carried in a recess or through hole of a porous sheet as liquid or solid material. The most effective method for each ink as above described in the present invention is a film boiling method as above indicated.

Further, an ink jet recording apparatus according to this invention may be used for an image output terminal in an information processing equipment such as a computer, an electronic typewriter, a copying machine in combination with a reader, or a facsimile terminal equipment having the transmission and reception feature.

As described above, according to the present invention, an effective suction recovery processing and the protection of a recording head when not recording can be accomplished by assuring the suction recovery processing and the capping when not recording, even for a recording head having the discharge port formation face not parallel to a record face of recording medium and having a step near the discharge ports.

The pressure variation acting on the discharge port formation face when attaching or detaching a cap can be relieved by making an edge portion of the cap and the discharge port formation face not parallel.

What is claimed is:

1. An ink jet recording apparatus having an ink jet recording head and a cap, said apparatus comprising:

said recording head, said recording head having a discharge port face with a discharge port arranged thereon; and a recovery device, comprising said cap for covering said discharge port face, said cap having an interior and comprising a body portion and an edge portion opposing said discharge port face and having a leading end, said edge portion comprising an elastic member for covering a periphery of said discharge port, wherein during a capping operation a plane defined by the leading end of said edge portion is not parallel to said discharge port face and said edge portion is not displaced in a direction different from a capping direction between said cap and said ink jet recording head, wherein a part of the leading end of said edge portion in contact with said discharge port face defines a contact portion between said leading end of said edge portion and said discharge port face, and said contact portion increases during the capping operation as said leading end approaches said discharge port face and gradually comes into contact with said discharge port face, said discharge port face being capped with the entire leading end of said edge portion in contact therewith when the capping operation is terminated.

2. An apparatus according to claim 1, wherein said edge portion has a trapezoidal cross-sectional profile.

3. An apparatus according to claim 1, wherein said edge portion has irregularities toward said discharge port face.

4. An apparatus according to claim 1, wherein said recording head comprises a plurality of heating elements for generating heat energy for discharging said ink.

5. An apparatus according to claim 1, wherein said recording head causes a change in a state of said ink due to film boiling in said ink, through an application of heat energy generated by said heating elements, and discharges said ink in response to said change in said state.

6. An apparatus according to claim 1, wherein said discharge port face and a surface defined by a leading end of said edge portion are non-parallel.

7. An apparatus according to claim 1, wherein when said cap covers said discharge port face, said cap and said recording head are in contact with each other in a state where said body portion and said discharge port face are non-parallel.

8. An apparatus according to claim 1, wherein said apparatus is a word processor.

9. An apparatus according to claim 1, wherein said apparatus is an electronic typewriter.

* * * * *

UNITED STATES PATENT AND TRADEMARK OFFICE

CERTIFICATE OF CORRECTION

PATENT NO. : 5,992,965
DATED : November 30, 1999
INVENTOR(S) : Katayanagi et al.

It is certified that error appears in the above-identified patent and that said Letters Patent is hereby corrected as shown below:

Title page,
Item [75], Inventors,
"Jun Katayanagi, Masashino" should read -- Jun Katayanagi, Musashino --;

[*]: "[*] Notice: This patent issued on a continued prosecution application filed under 37 CFR 1.53 (d), and is subject to the twenty year patent term provisions of 35 U.S.C. 154 (1) (2)" should be deleted.

FOREIGN PATENT DOCUMENTS,
"162656" should read -- 60-162656 --.

Column 1,
Line 16, "the" should read -- an --, and "with said" should read -- using the --;
Line 21, "This" should read -- That --, and "disclosed" should read -- discloses --;
Line 23, "of" should read -- of a --;
Line 27, "capping" should read -- the capping --;
Line 34, "was" should read -- is --;
Line 35, "out of the cap with" should read -- by using suction means. The capping member is also required to exhibit --;
Line 36, "suction means, along with an air" should be deleted;
Line 37, "is" should read -- exists --;
Line 39, "from a manufactural and technical problem," should be deleted;
Line 41, "face is" should read -- face as indicated above is --, and "as" should be deleted;
Line 42, "above indicated" should be deleted;
Line 43, "discharge ports. Even" should read -- discharging ports. This creates a manufacturing and technical problem in that even --;
Line 44, "such" should read -- such a --;
Line 45, "face was" should read -- face were --;
Line 46, "shut" should read -- position --;
Line 51, "since" should read -- when --;
Line 52, "with a deformation owing" should read -- resulting in deformation of the cap due --;
Line 53, "will" should be deleted;
Line 54, "decrease" should read -- decreases --;
Line 55, "was provided to avoid the" should read -- has been provided to avoid --;
Line 57, "phenominum, which led to a" should read -- phenomenon, yet it led to an additional --;
Line 60, "was" should read -- is --;

UNITED STATES PATENT AND TRADEMARK OFFICE

CERTIFICATE OF CORRECTION

PATENT NO. : 5,992,965
DATED : November 30, 1999
INVENTOR(S) : Katayanagi et al.

It is certified that error appears in the above-identified patent and that said Letters Patent is hereby corrected as shown below:

Column 1, cont'd,
Line 62, "or detached" should read -- to or detached from --;
Line 63, "in" should read -- and --; and
Line 66, "a little" should be deleted.

Column 2,
Line 2, "strong" should read -- high --;
Line 32, "PERSPECTIVE VIEW SHOWING A CON-" should read -- perspective view showing a con- --;
Line 33, "FIGURATION OF A WORD PROCESSOR AS ONE" should read -- figuration of a word processor as one --;
Line 34, "EXAMPLE OF DEVICE TO WHICH THE PRESENT" should read -- example of device to which the present --; and
Line 35, "INVENTION IS APPLIED" should read -- invention is applied --.

Column 3,
Line 3, "M-M" should read -- D-D --;
Line 26, "said" should read -- the --;
Line 28, "They" should read -- The protection cover 3 and the spur cover 4 --;
Line 36, "Here" should be deleted;
Line 43, "is" should read -- is an --;
Line 46, "FIG." should read -- Figs. --; and
Line 57, "(thereafter" should read -- (hereafter --.

Column 4,
Line 56, "f = of of the redcording head. And near" should read -- of the recording head. Near --;
Line 64, "show exploded perspective views of the" should read -- respectively show an exploded perspective view and an external perspective view --; and
Line 65, "head" should read -- of the head --.

Column 5,
Line 1, "the same figure," should read -- Fig. 4A, --;
Line 3, "A1" should read -- Aℓ --;
Line 4, "Si" should read -- silicone --;
Line 11, "6" should read -- ⊖ --;
Line 14, "correspondingly" should read -- corresponding --;
Line 16, "for" should read -- due to --; and
Line 17, "is" should read -- are --

UNITED STATES PATENT AND TRADEMARK OFFICE

CERTIFICATE OF CORRECTION

PATENT NO. : 5,992,965
DATED : November 30, 1999
INVENTOR(S) : Katayanagi et al.

It is certified that error appears in the above-identified patent and that said Letters Patent is hereby corrected as shown below:

Column 6,
Line 21, "And on" should read -- On --; and
Line 22, "do such a thing" should read -- ensure visually that unit 9a is in a capping position --.

Column 9,
Line 10, "13A" should read -- Fig. 13A --;
Line 28, "whole" should read -- all --;
Line 33, "of" should read -- of the --;
Line 35, "FIG. C," should read -- Fig. 4C, --;
Line 42, "with" should read -- and lacking --;
Line 43, "a low" should be deleted;
Line 57, "M-M" should read -- D-D --; and
Line 63, "600" should read -- 60° --.

Column 10,
Line 6, "cap" should read -- the cap 51 --;
Line 36, "ace" should read -- face --, and "whole the" should read -- the entire --;
Line 45, "whole" should read -- entire --; and
Line 52, "of" should read -- of a --.

Column 12,
Line 9, "though" should read -- although --.

Column 14,
Line 1, "claim 1," should read -- claim 4, --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*